US010012466B2

(12) United States Patent
Whitworth

(10) Patent No.: US 10,012,466 B2
(45) Date of Patent: Jul. 3, 2018

(54) FIREARM BORE CLEANING DEVICE

(71) Applicant: James Curtis Whitworth, Commerce Township, MI (US)

(72) Inventor: James Curtis Whitworth, Commerce Township, MI (US)

( * ) Notice: Subject to any disclaimer, the term of this patent is extended or adjusted under 35 U.S.C. 154(b) by 0 days.

(21) Appl. No.: 15/061,741

(22) Filed: Mar. 4, 2016

(65) Prior Publication Data

US 2016/0258705 A1 Sep. 8, 2016

Related U.S. Application Data

(60) Provisional application No. 62/129,190, filed on Mar. 6, 2015.

(51) Int. Cl.
*F41A 29/02* (2006.01)

(52) U.S. Cl.
CPC ..... *F41A 29/02* (2013.01)

(58) Field of Classification Search
CPC ..... F41A 29/00; F41A 29/02; F41A 29/04
USPC ..... 42/95
See application file for complete search history.

(56) References Cited

U.S. PATENT DOCUMENTS 589,086 A 8/1897 Hubbard
705,396 A * 7/1902 Garrison ..... F41C 31/00 42/95
938,836 A 11/1909 Fessenden
1,039,774 A 10/1912 Melander
1,231,227 A 6/1917 Williams
1,495,008 A 5/1924 Feagin
1,738,601 A * 12/1929 Metzger ..... F41A 29/02 15/104.19
2,047,897 A 7/1936 Symes
2,660,002 A 11/1953 Farley
2,765,740 A 10/1956 Norman
3,064,294 A * 11/1962 Stocking ..... F41A 29/02 15/104.19
3,147,708 A 9/1964 Ferguson
3,209,690 A 10/1965 Mercatoris, Jr.
3,217,648 A 11/1965 Foote et al.
3,285,174 A 11/1966 Moehlman et al.
3,476,047 A 11/1969 Davis
3,682,556 A 8/1972 Hanson
3,740,883 A 6/1973 Kyle
4,328,632 A 5/1982 Beers
4,513,668 A 4/1985 Fuller
4,843,750 A 7/1989 Blase
(Continued)

FOREIGN PATENT DOCUMENTS

FR 1.146.903 * 5/1957
RU 2293943 C2 2/2007
WO WO 2014186308 A1 11/2014

OTHER PUBLICATIONS

U.S. Appl. No. 14/792,127, Whitworth, J.C.

*Primary Examiner* — Stephen Johnson
(74) *Attorney, Agent, or Firm* — Vincent Re PLLC

(57) ABSTRACT

A bore cleaning device is disclosed that is configured to clean a bore of a firearm. Devices disclosed herein receive force manually applied by the user to push, pull, or propel the device through the bore. The device includes an internal mechanism configured to translate one of a pushing force and a pulling force into an outward radial force forcing intimate contact between device surfaces and interior walls of the bore.

3 Claims, 12 Drawing Sheets

(56) References Cited

U.S. PATENT DOCUMENTS

| | | | | |
|---|---|---|---|---|
| 4,998,368 | A | 3/1991 | Blase | |
| 5,164,539 | A | 11/1992 | French | |
| 5,233,128 | A | 8/1993 | Lai | |
| 5,341,744 | A | 8/1994 | Shi | |
| 5,777,258 | A | 7/1998 | Soon | |
| 5,871,589 | A | 2/1999 | Hedge | |
| 5,970,878 | A | 10/1999 | Gardner | |
| 5,972,125 | A | 10/1999 | Hedge | |
| 6,088,866 | A | 7/2000 | Hedge | |
| 6,105,591 | A | 8/2000 | Decare et al. | |
| 6,389,978 | B1 | 5/2002 | Hooper et al. | |
| 6,691,446 | B2 | 2/2004 | Graves | |
| 7,131,381 | B1 | 11/2006 | Nafziger | |
| 7,150,229 | B2 | 12/2006 | Gardner | |
| 7,367,151 | B1 | 5/2008 | Black et al. | |
| 7,441,363 | B1 | 10/2008 | Black et al. | |
| 7,451,707 | B1 | 11/2008 | Hadden | |
| 7,707,942 | B1 | 5/2010 | Gardner | |
| 7,743,706 | B1 | 6/2010 | Lai | |
| 7,980,388 | B2 | 7/2011 | Dewey | |
| 8,051,776 | B1 | 11/2011 | Bailey | |
| 8,146,284 | B2 | 4/2012 | Smith | |
| 8,943,731 | B2 | 2/2015 | Niebling | |
| 9,052,172 | B2 | 6/2015 | Whitworth | |
| 9,134,087 | B2 | 9/2015 | Canham | |
| 9,212,879 | B2 | 12/2015 | Whitworth | |
| 2002/0129725 | A1 | 9/2002 | Bice et al. | |
| 2004/0244627 | A1 | 12/2004 | Bice et al. | |
| 2011/0016649 | A1 | 1/2011 | Reggio et al. | |
| 2011/0099880 | A1 | 5/2011 | Stephens et al. | |
| 2011/0119845 | A1 | 5/2011 | Kim | |
| 2012/0124883 | A1* | 5/2012 | Reggio ..... | F41A 29/02 42/95 |
| 2012/0198747 | A1 | 8/2012 | Niebling | |
| 2014/0331886 | A1 | 11/2014 | Whitworth | |

* cited by examiner

FIREARM BORE CLEANING DEVICE

CROSS REFERENCE TO RELATED APPLICATIONS

This disclosure claims the benefit of U.S. Provisional Application No. 62/129,190 filed on Mar. 6, 2015, which is hereby incorporated by reference.

TECHNICAL FIELD

The present disclosure relates to a device for removing material such as gunpowder or propellant residue, carbon, lead, metals, and plastic contaminants from the bore of a firearm, and more particularly relates to a plug that can be pulled or pushed through the bore of a firearm, and the motive force applied to the plug is transformed into an outward force, pressing cleaning materials against the inside of the bore as the force moves the plug through the bore.

BACKGROUND

The statements in this section merely provide background information related to the present disclosure. Accordingly, such statements are not intended to constitute an admission of prior art.

Cleaning the bore of a firearm after use is generally required to prevent possible damage due to caustic materials causing corrosion to the bore. It is often true that the task of manually cleaning a firearm is most undesirable when the condition of the firearm is most suitable for bore damage; for example at the end of an outing under inclement conditions.

Known devices for manually cleaning the bore of a firearm include cotton swabs, wire brushes, jags, patches, or other cleaning materials which are pushed or pulled through the bore. Abrasive contact between the cleaning materials, with or without the aid of lubricants and/or solvents, remove contaminants from the length of the bore. The cleaning materials can be a same or similar diameter as the inner diameter of the bore. In some embodiments, the cleaning materials outside of the bore can be larger in diameter than the inner diameter of the bore. However, in the act of forcing the cleaning materials into the bore, the cleaning materials are compressed or deformed into a shape that can be fit within an inner diameter of the bore. Because only a limited amount of cleaning material can be fit within the bore, only a limited amount of scrubbing force can thusly be applied to the inside of the bore.

SUMMARY

A bore cleaning device is disclosed that is configured to clean a bore of a firearm. Devices disclosed herein receive force manually applied by the user to push, pull, or propel the device through the bore. The device includes an internal mechanism configured to translate one of a pushing force and a pulling force into an outward radial force forcing intimate contact between device surfaces and interior walls of the bore.

BRIEF DESCRIPTION OF THE DRAWINGS

One or more embodiments will now be described, by way of example, with reference to the accompanying drawings, in which.

DETAILED DESCRIPTION

Figure 1:
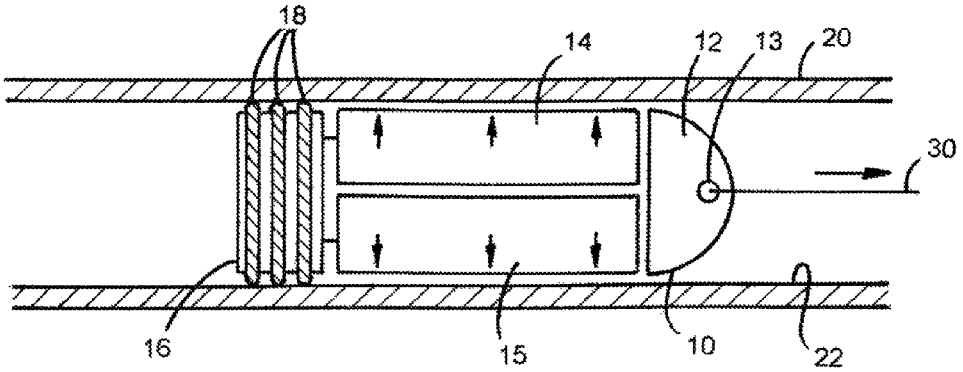
FIG. 1 illustrates an exemplary bore cleaning device transforming a pull force from an attached cord into a radial force against the inside of a bore of a firearm, in accordance with the present disclosure.

Referring now to the drawings, wherein the showings are for the purpose of illustrating certain exemplary embodiments only and not for the purpose of limiting the same, a bore cleaning device can be used to wipe or scrub contaminants from the bore of a firearm. Contaminants in a bore can include gunpowder residue, lead or copper from bullets fired through the bore, brass shavings from shell casings, dirt or other intrusive contaminants, and/or corrosion within the bore caused by humidity interacting with the material of the firearm barrel. Scrubbing brushes and materials are known for use in cleaning out a bore, wherein the operator of the firearm disassembles the firearm and pushes or pulls cleaning materials through the bore. Cleaning solvents and/or lubricating liquids can be used to aid in the cleaning process.

Conventional cleaning devices include wads of fibrous material or metallic brushes which are forced into the bore of a firearm. These objects can soaked or coated with solvent or oil and can be pushed or pulled through the length of the bore. However, a radial force applied by the cleaning materials against an inside of the bore is limited by how much material can be compressed within the bore (e.g. how much wadding can be compressed or spring force in the bristles of the brush device.)

A bore cleaning device is disclosed which provides an outward or radial force against the inside of a bore of a firearm in response to or as a result of force being applied to push or pull the device longitudinally along the length of the bore. This radial or outward force creates intimate contact between cleaning materials such as bristles, fibrous pads, rubberized wipers, and similar structures and the inside of the bore of the firearm. This intimate contact scrubs the inside of the bore more effectively than cleaning materials just stuffed within the bore. Further, embodiments of the disclosure enable cleaning the inside of the bore without disassembling the firearm, enabling easy cleaning. Devices disclosed herein receive force manually applied by the user to push, pull, or propel the device through the bore.

FIG. 1 illustrates an exemplary bore cleaning device transforming a pull force from an attached cord into a radial force against the inside of a bore of a firearm. Bore cleaning device 10 is illustrated within bore 22 of firearm barrel 20. Device 10 includes a forward end cap 12, expanding panels 14 and 15, and rearward end cap 16. Forward end cap 12 includes hole 13 that allows attachment of cord 30, which can be used to manually pull the device through bore 22. Tensile force applied to device 10 through end cap 12 is transformed by internal workings of device 10 into an outward radial force pushing expanding panels 14 and 15 outwardly against bore 22. Cleaning materials can be wrapped around panels 14 and 15/positioned between panels 14 and 15 and bore 22, or cleaning materials can be attached to panels 14 and 15. Rearward end cap 16 includes wipers 18 configured to wipe the bore 22 as device 10 is pulled through bore 22. Force resisting pulling wipers 18 along bore 22 is used to activate the transformation of force within the device.

Figure 2:
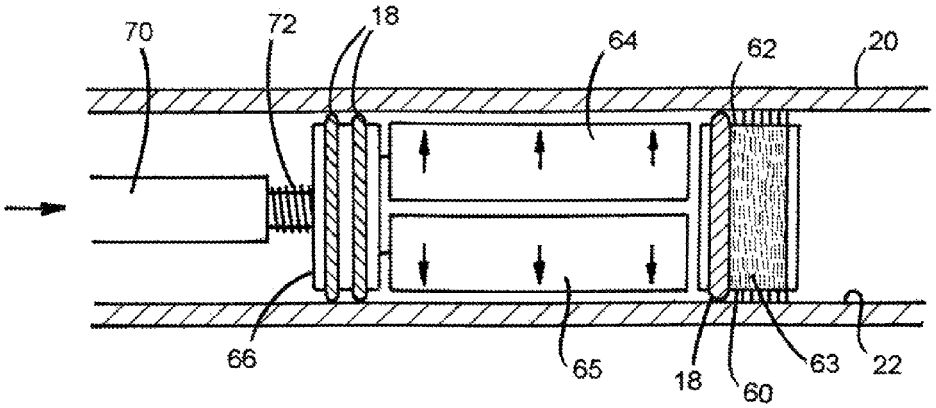
FIG. 2 illustrates an exemplary bore cleaning device transforming a push force from a pole into a radial force against the inside of a bore of a firearm, in accordance with the present disclosure.

FIG. 2 illustrates an exemplary bore cleaning device transforming a push force from a pole into a radial force against the inside of a bore of a firearm. Bore cleaning device 60 is illustrated within bore 22 of firearm barrel 20. Device 60 includes a forward end cap 62, expanding panels 64 and 65, and rearward end cap 66. Forward end cap 62 includes brush bristles 63 and wiper 18 configured to wipe the bore 22 as device 60 is pulled through bore 22. Rearward end cap 66 includes wipers 18 configured to wipe bore 22 and is configured to receive a pushing force from pole 70. Pole 70 can be configured with threading 72 to screw into a mating hole in end cap 66. In other embodiments, pole 70 can simply push upon end cap 66. Force resisting pushing wiper 18 and bristle 63 upon end cap 62 along bore 22 is used to activate the transformation of force within the device. Compressive force applied to device 60 through pushing end cap 66 is transformed by internal workings of device 60 into an outward radial force pushing expanding panels 64 and 65 outwardly against bore 22. Cleaning materials can be positioned around or between panels 64 and 65 and bore 22, or cleaning materials can be attached to panels 64 and 65.

Figure 3A:
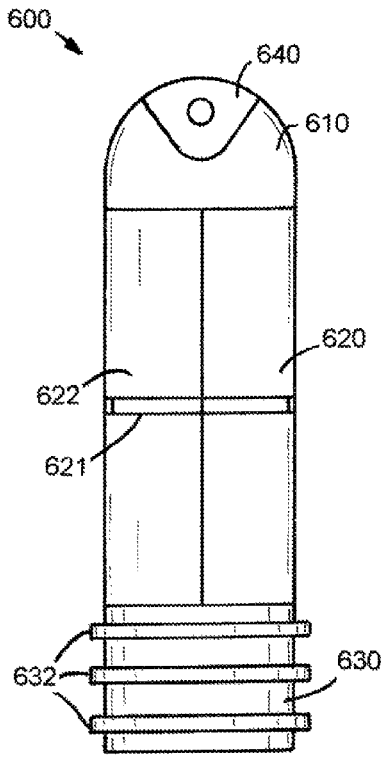
FIG. 3A illustrates an exemplary bore cleaning device, illustrating expanding panels in a retracted state, in accordance with the present disclosure.

FIG. 3A illustrates an exemplary bore cleaning device, illustrating expanding panels in a retracted state. Device 600 is illustrated including forward end cap 610, expanding panels 620 and 622, rearward end cap 630, and spring loaded plunger end tab 640. Spring loaded plunger end tab 640 is part of a plunger that extends down the middle of the device and is spring loaded into a retracted position, as illustrated in FIG. 3A. Expanding panels 620 and 622 are illustrated in a retracted state, held close to the rest of the device. Panels 620 and 622 can be held in the retracted state in a number of ways. A spring device can extend through a center of the device and attach to a tab on each of the panels 620 and 622. According to another embodiment, an elastic band can be fit within groove 621 which can extend around the expanding panels 620 and 622. Forward end cap 610 can be separable from the rest of the device, providing selective access to the hollow core of the device to install or remove the plunger. Rearward end cap 630 can include wipers 632 configured to wipe a bore of a firearm. Friction force between wipers 632 and the bore, along with a pulling force on tab 640, provide force to activate the expanding panels of the device.

Figure 3B:
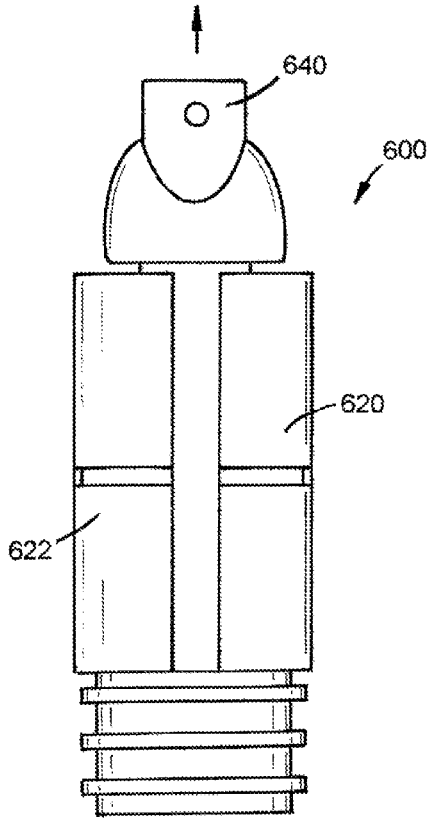
FIG. 3B illustrates the bore cleaning device of FIG. 3A, with the expanding panels in an extended state, in accordance with the present disclosure.

FIG. 3B illustrates the bore cleaning device of FIG. 3A, with the expanding panels in an extended state. Device 600 is illustrated, including spring loaded plunger end tab 640 in a pulled out state and expanding panels 620 and 622 in an extended state. As tensile pulling force is applied to tab 640, ramps within the device push panels 620 and 622 away from the body of the device. This outward radial force can be used to press cleaning materials against the bore of the firearm.

Figure 3C:
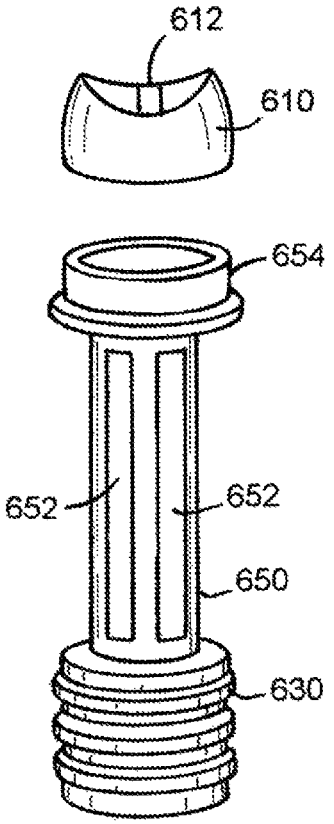
FIG. 3C illustrates a hollow central housing and rearward end cap of the device of FIG. 3A configured to receive the spring loaded plunger and a screw on forward end cap, in accordance with the present disclosure.

FIG. 3C illustrates a hollow central housing and rearward end cap of the device of FIG. 3A configured to receive the spring loaded plunger and a screw on forward end cap. Hollow central housing 650 is illustrated including integrated end cap 630, ramp exposing slots 652, and end portion 654 configured to receive forward end cap 610. End portion 654 and end cap 610 can be glued, snap fit, or otherwise fit together according to methods known in the art. End cap 610 is illustrated including a slot 612 configured to permit tab 640 to extend from the cap. The central housing is hollow, including a round opening and central cavity configured to receive the plunger attached to tab 640. Within the cavity proximate to end cap 630, a tab or other attachment point is provided to connect a spring to return the plunger to a normally retracted state.

Figure 3D:
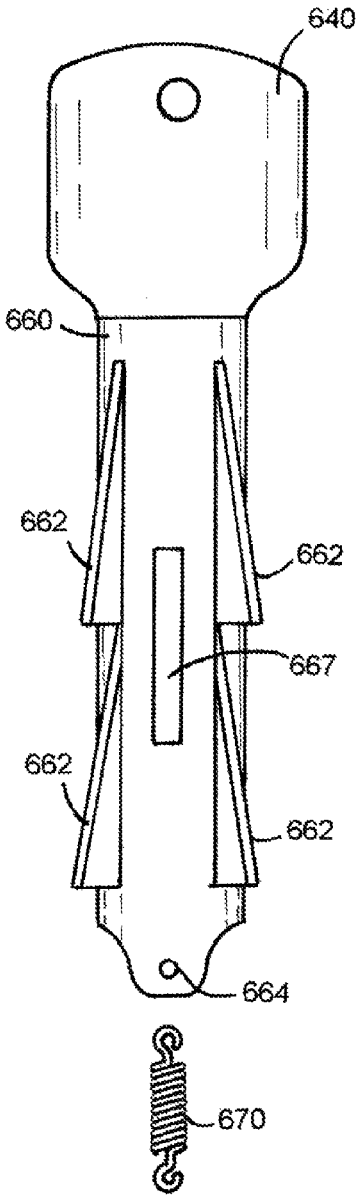
FIG. 3D illustrates a spring loaded plunger including expanding panel activating ramps, in accordance with the present disclosure.

FIG. 3D illustrates a spring loaded plunger including expanding panel activating ramps. Spring loaded plunger 660 is illustrated including tab 640, expanding panel activating ramps 662, and spring receiving tab 664. Spring 670 is illustrated providing a force returning the plunger 660 to a normally retracted state. Optional cavity 667 is illustrated, permitting a spring to extend through a middle of the device to return the expanding panels to a normally retracted state.

Figure 3E:
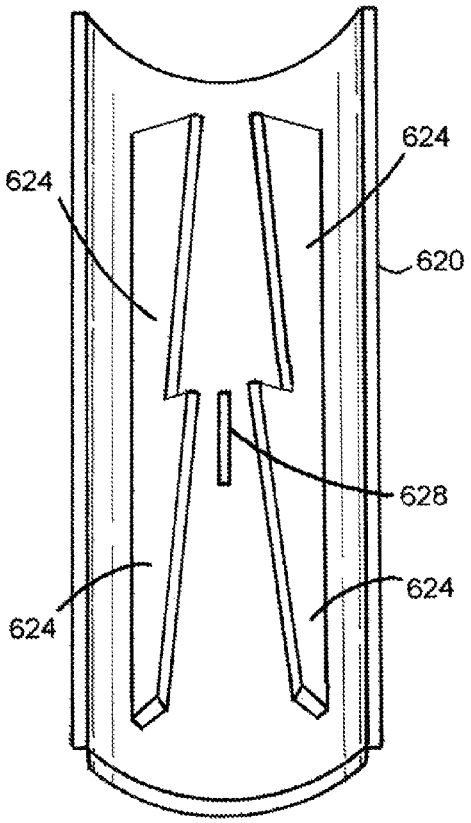
FIG. 3E illustrates an expanding panel including expanding panel activating ramps configured to mate with the ramps of the plunger of FIG. 3D, in accordance with the present disclosure.

FIG. 3E illustrates an expanding panel including expanding panel activating ramps configured to mate with the ramps of the plunger of FIG. 3D. Expanding panel 620 is illustrated including expanding panel activating ramps 624 configured as inverse matches to the ramps 662 of FIG. 3D, such that as the ramps slide in relation to each other, and outward radial force can be applied to the expanding panels. Panel 620 also includes an optional tab configured to receive a spring to connect to a similar tab on the opposite expanding panel, such that the panels are returned to a normally retracted state. Ramps 624 and 662, as illustrated, can each be described as triangle-shaped ramp structures.

Figure 3F:
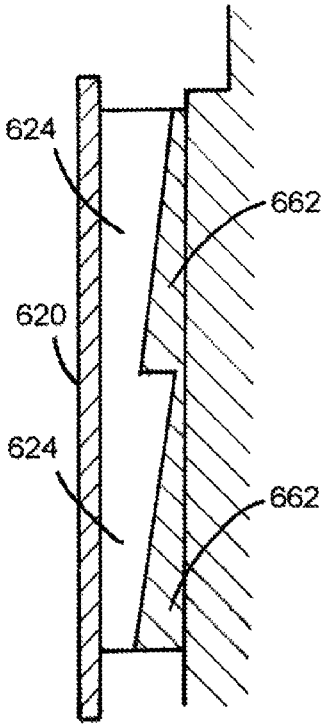
FIG. 3F illustrates the mating ramps of FIGS. 3D and 3E, with the ramps in a position corresponding to the panel being in a retracted state, in accordance with the present disclosure.

FIG. 3F illustrates the mating ramps of FIGS. 3D and 3E, with the ramps in a position corresponding to the panel being in a retracted state. Expanding panel 620 is illustrated including expanding panel activating ramps 624. Plunger 660 is illustrated including expanding panel activating ramps 662. Ramps 624 and 662 are illustrated in a fully seated condition, permitting a hollow central housing containing the plunger 660 and panel 620 to be as close to each other as possible corresponding to the panels being in a retracted state.

Figure 3G:
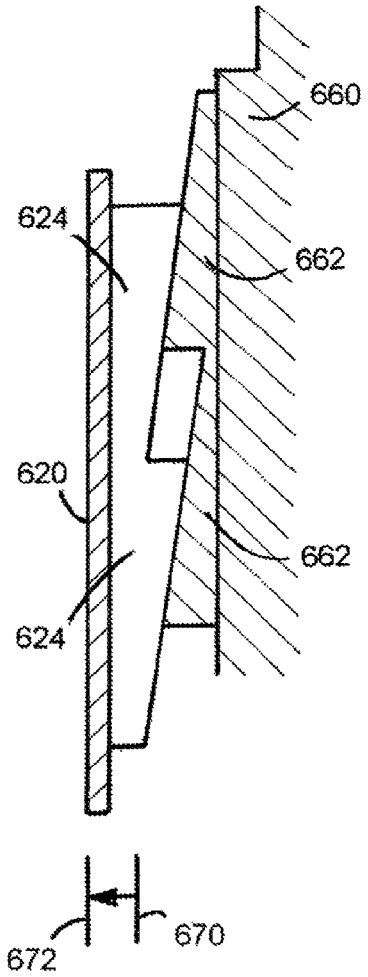
FIG. 3G illustrates the mating ramps of FIGS. 3D and 3E, with the ramps in a position corresponding to the panel being in an extended state, in accordance with the present disclosure.

FIG. 3G illustrates the mating ramps of FIGS. 3D and 3E, with the ramps in a position corresponding to the panel being in an extended state. Expanding panel 620 is illustrated including expanding panel activating ramps 624. Plunger 660 is illustrated including expanding panel activating ramps 662. Plunger 660 has been pulled or extended. Ramps 662 are illustrated moved upward in relation to ramps 624. Line 670 represents a position occupied by expanding panel 620 in a retracted state. Line 672 represents a position occupied by expanding panel 620 in an expanded state. By moving the ramps as illustrated, the expanding panel 620 is moved from original position 670 to extended position 672. In this way, an outward radial force can be applied through expanding panel 620. The ramps act as a force transformer, transforming a pulling force on the plunger into an outward radial force.

Figure 4:
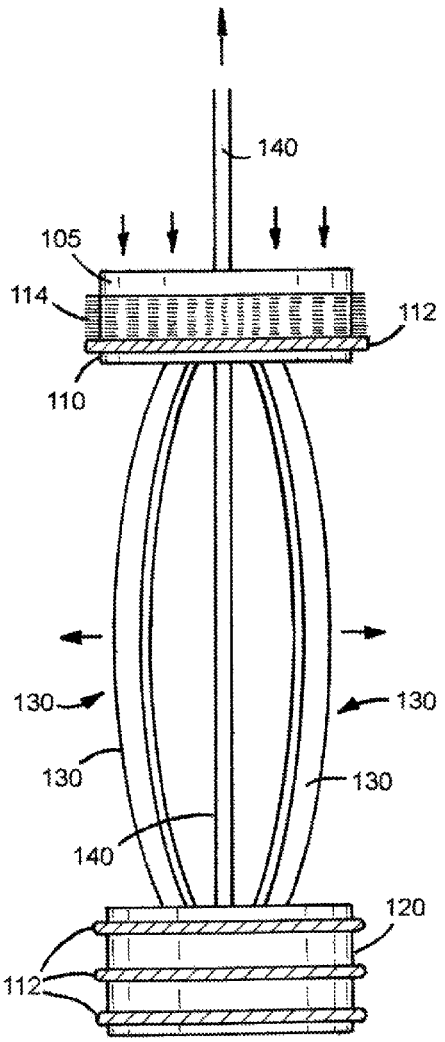
FIG. 4 illustrates another exemplary bore cleaning device, illustrating internal features of the device including flexible legs configured to provide an outward radial force against cleaning materials surrounding the flexible legs, in accordance with the present disclosure.

FIG. 4 illustrates another exemplary bore cleaning device, illustrating internal features of the device including flexible legs configured to provide an outward radial force against cleaning materials surrounding the flexible legs. Bore cleaning device carrier 105 is illustrated, including a forward end cap 110, a rearward end cap 120, and flexible legs 130 configured to bend and provide an outward force to cleaning materials that can be installed around flexible legs 130. End cap 120 can include wipers 112. Flexible legs 130 can include two, three, four or more legs. In the exemplary embodiment of FIG. 4, two legs 130 are illustrated with another two legs being referenced behind the two visible legs. Cord 140 is illustrated passing through end cap 110 and connecting to end cap 120. Forward end cap 110 includes brush bristles 140 and wiper 112 configured to wipe along a bore of a firearm. As end cap 110 wipes along the bore, friction causes end cap 110 to apply a compressive force upon flexible legs 130. Compressive force applied to flexible legs 130 causes the legs to bend outwardly, thereby pressing the cleaning materials installed thereto against the bore.

Flexible legs 130 can be constructed of flexible plastic or fiberglass with thin enough cross section to permit the legs to easily flex. In another example, flexible legs 130 can be made of metal such as spring steel.

Wipers can take a number of different forms, including rubberized disks, o-rings, over-molded flexible rubberized material, closed cell foam, or any other similar materials.

Figure 5A:
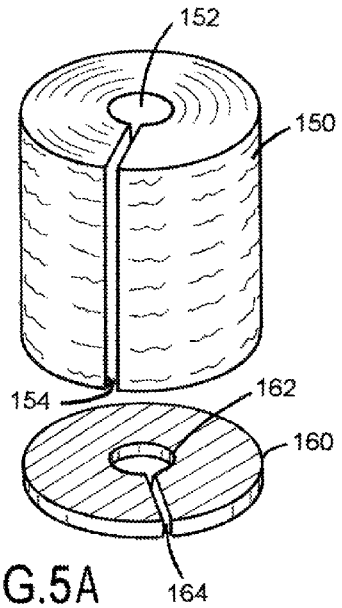
FIG. 5A illustrates exemplary cleaning materials that can be placed around the flexible legs of the device of FIG. 4, in accordance with the present disclosure.

FIG. 5A illustrates exemplary cleaning materials that can be placed around the flexible legs of the device of FIG. 4. A fibrous pad 150 including an exemplary center hole 152 and slot 154 is illustrated. Wiper 160 similarly includes exemplary center hole 162 and slot 164. Center holes 152 and 162 are configured to accept flexible legs 130, and slots 154 and 164 are configured to enable installation of the cleaning materials to the legs and to enable expansion of the cleaning materials against the neighboring bore when the legs apply force to the inside of the cleaning materials.

Figure 5B:
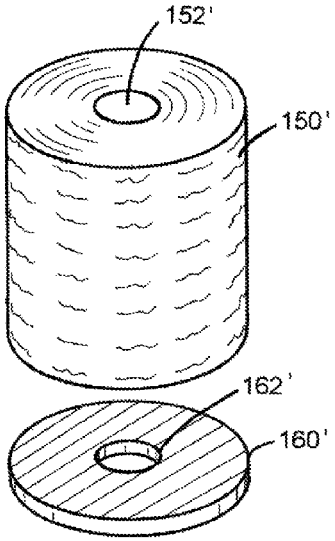
FIG. 5B illustrates alternative exemplary cleaning materials that can be placed around the flexible legs of the device of FIG. 4, in accordance with the present disclosure.

FIG. 5B illustrates exemplary cleaning materials that can be placed around the flexible legs of the device of FIG. 4. A fibrous pad 150' including an exemplary center hole 152' is illustrated. Wiper 160' similarly includes exemplary center hole 162'. Center holes 152' and 162' are configured to accept flexible legs 130. Instead of providing slots in pad 150' and wiper 160' as are illustrated in FIG. 5A, pad 150' and wiper 160' are instead constructed of materials that can stretch slightly when flexible legs apply an outward radial force from within.

Figure 6:
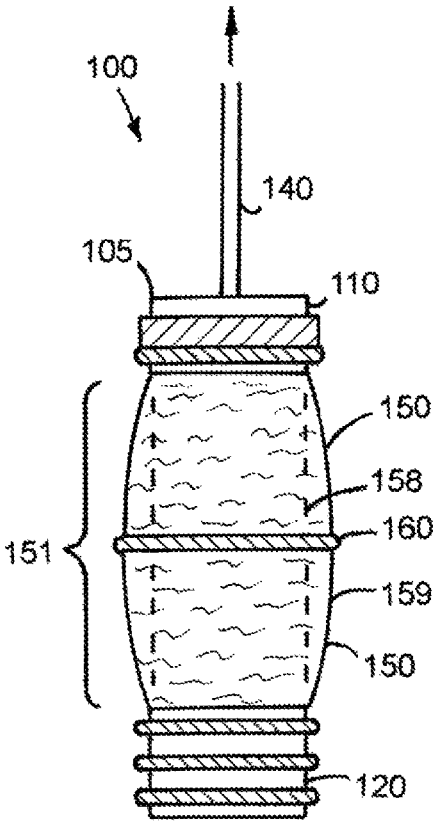
FIG. 6 illustrates the device of FIG. 4 with cleaning materials of FIG. 5 placed around the flexible legs of the device, in accordance with the present disclosure.

FIG. 6 illustrates the device of FIG. 4 with cleaning materials of FIG. 5 placed around the flexible legs of the device. Bore cleaning device 100 includes carrier 105 and cleaning materials 151 including exemplary fibrous pads 150 and wiper 160. Carrier 105 includes forward end cap 110 and rearward end cap 120. Profile 158 illustrated as dotted lines shows device 100 in a relaxed or resting state, with flexible legs inside the device in a relaxed straight or only slightly bent state. Profile 159 illustrates as a solid line shows device 100 in a compressed state, with flexible legs inside the device applying an outward radial force against the insides of cleaning materials 151. The degree of expansion of cleaning materials 151 to profile 159 is illustrated in an exaggerated state for illustration. The actual amount of expansion between the relaxed state at profile 158 and the compressed state at profile 159 can be any amount necessary to apply the outward radial force upon the bore.

Figure 7:
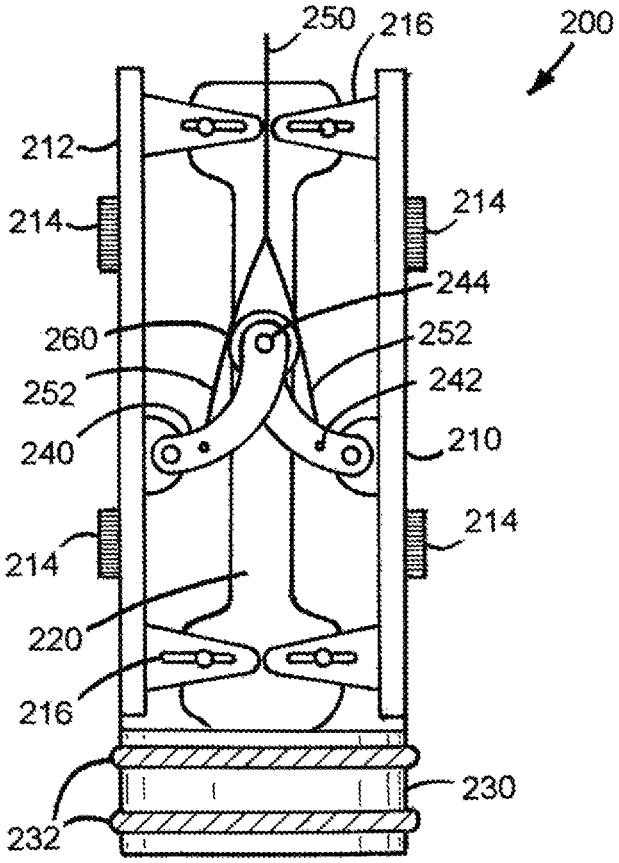
FIG. 7 illustrates another exemplary bore cleaning device, illustrating internal features of the device including spring loaded cams configured to provide an outward radial force against cleaning materials, in accordance with the present disclosure.

FIG. 7 illustrates another exemplary bore cleaning device, illustrating internal features of the device including spring loaded cams configured to provide an outward radial force against cleaning materials surrounding the flexible legs. Bore cleaning device 200 is illustrated including expanding panels 210 and 212 and rearward end cap 230. Rearward end cap 230 includes wipers 232 configured to wipe along a bore as device 200 is pulled down the bore. Friction between wipers 232 and the bore activate the device as the device is pulled down the bore. Cord 250 is used to pull device 200 down the bore. Device 200 includes carrier 220 including slot features 216 configured to enable inward and outward movement of panels 210 and 212. Carrier 220 further includes an axle 244 connecting a first cam 240 and a second cam 242 to a coil spring 260. Coil spring 260 is configured to keep cams 240 and 242 in a pulled inward state, such that panels 210 and 212 are pulled inward. Cord 250 includes a split into cords 252 attached to each of cams 240 and 242. As a pulling force is applied to cord 250, cams 240 and 242 are rotated outwardly, overcoming the force applied by spring 260. Tensile force in device 200 is created by the frictional force between wipers 232 and the pulling force applied to cord 250. Exemplary bristles 214 are attached to panels 210 and 212 to clean the bore as panels 210 and 212 are forced outwardly against the bore.

Figure 8:
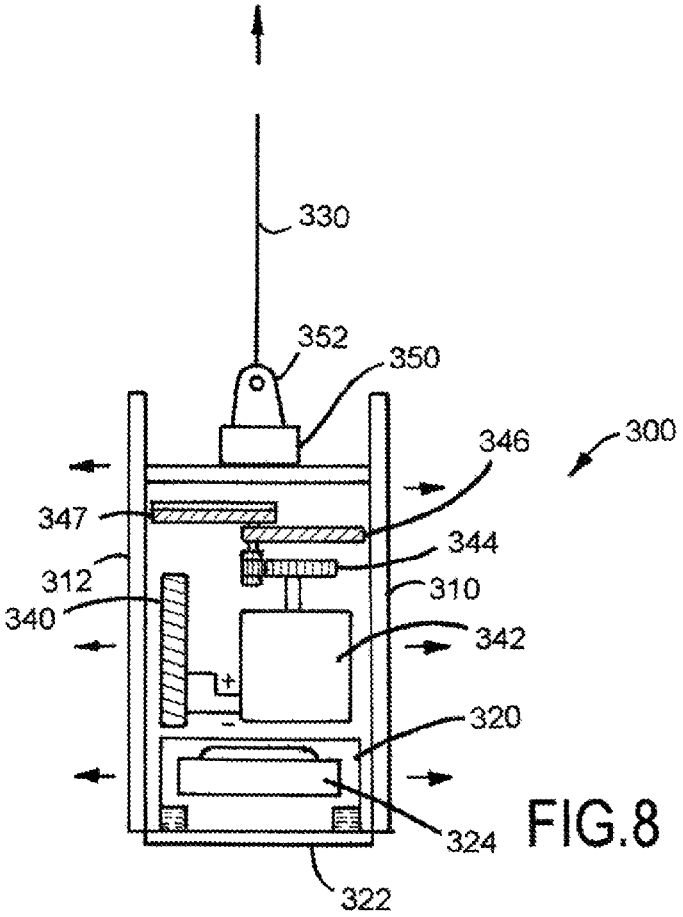
FIG. 8 illustrates another exemplary bore cleaning device, illustrating internal features of the device including a motor controlled by a circuit board, controlling the motor applying an outward force in response to a pulling force applied to a force sensor, in accordance with the present disclosure.

FIG. 8 illustrates another exemplary bore cleaning device, illustrating internal features of the device including a motor controlled by a circuit board, controlling the motor applying an outward force in response to a pulling force applied to a force sensor. Device 300 is illustrated including expanding panels 310 and 312, battery 324, motor 342, circuit board 340, pull force sensor 350, and cam devices 346 and 347 configured to control an outward force applied to panels 310 and 312. Circuit board 340 includes electronic components known in the art, enabling the board to monitor a pull force applied to sensor 350 and apply a voltage to motor 342. Sensor 350 is known in the art and can include a piezoelectric sensor, wheatstone bridge sensor, or any other similar sensor that can provide a measurement of a pulling force. Sensor 350 is attached to cord 330 through attachment 352. Battery 324 is contained and connected electrically through battery compartment 320 including a screw on cap 322. Motor 342 is attached to gears 344 configured to move cams 346 and 347. Calibration of the control of motor 342 can be used to create a desired outward force against a bore. Such calibration can be pre-programmed or adjustable by a user. Feedback can be monitored, for example, by the circuit board monitoring current draw by the motor as a proxy to the outward radial force. In another example, a scalar force reading from the sensor 350 can be used to control panels 310 and 312, for example, with a zero force moving the panels to an inward, retracted state, with a threshold small pull force moving the panels to a fully extended state, and with increasing pulling force slowly retracting the panels. In this example, the user would continue to increase pulling force until the panels are retracted inwardly just enough so that the device will move along the bore, thereby maximizing the outward radial scrubbing force applied by panels 310 and 312. A number of exemplary control schemes to be applied by circuit board 340 are envisioned, and the disclosure is not intended to be limited to the examples provided herein.

Figure 9:
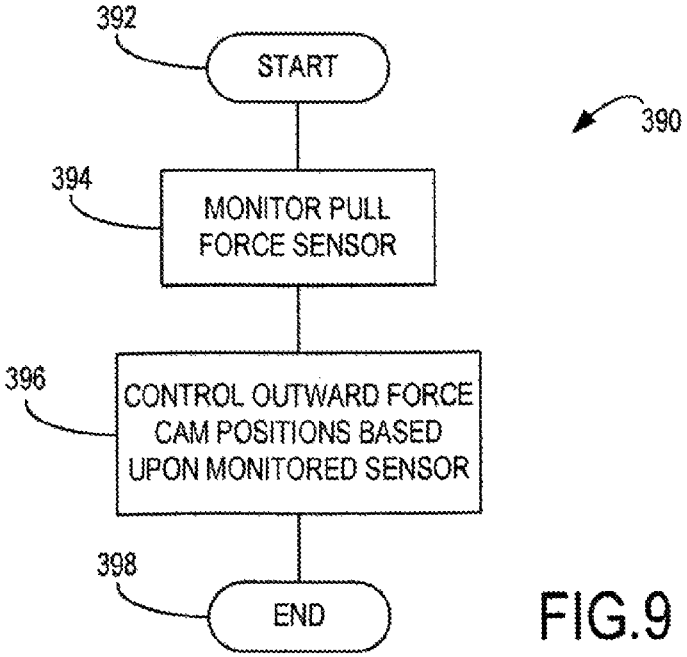
FIG. 9 illustrates an exemplary control process for the device of FIG. 8, in accordance with the present disclosure.

FIG. 9 illustrates an exemplary control process for the device of FIG. 8. Process 390 starts at step 392. At step 394, a pull force sensor is monitored. At step 396, cam positions controlling outward radial force upon expanding panels of the device are controlled based upon the monitored pull force sensor. Steps 394 and 396 repeat or reiterate as long as the device is activated. At step 398, the process ends.

Figure 10:
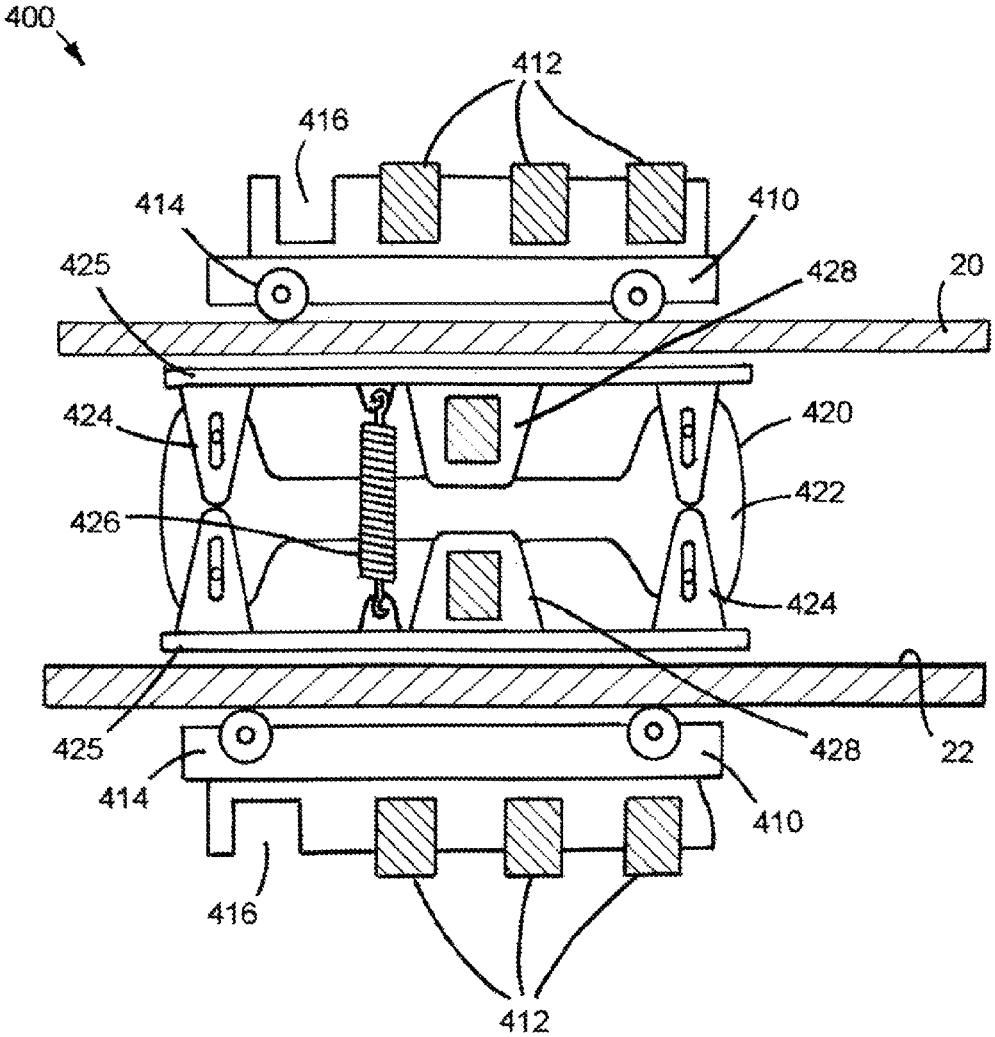
FIG. 10 illustrates another exemplary bore cleaning device, illustrating internal features of the device including magnetic force applied upon the device by an external magnet carrier device, in accordance with the present disclosure.

FIG. 10 illustrates another exemplary bore cleaning device, illustrating internal features of the device including magnetic force applied upon the device by an external magnet carrier device. Bore cleaning system 400 is illustrated including an external magnet carrier device 410 and a bore cleaning device 420. Bore cleaning device 420 is illustrated in section, including expanding panels 425 connected to a central carrier 422 with slot fixtures 424. Panels 425 include activating magnets 428. Panels 425 are connected and returned to a normally retracted state with spring 426.

External magnet carrier device 410 is illustrated including activating magnets 412. Activating magnets are configured to apply a magnetic force upon activating magnets 428. This magnetic force can be used to pull device 420 along bore 22 of barrel 20 of the firearm. The magnetic force can also be used to create and outward radial force through panels 425. Device 410 can include a C-shaped cross section, with the two ends of the C being illustrated by the two illustrated portions of device 410 in FIG. 10. In this way, the device can be fit around barrel 20 to provide a magnetic force on both sides of barrel 20 simultaneously. Force applied by device 410 can be adjustable. Empty slots 416 illustrate locations where additional magnets 412 can be installed to device 410 to provide additional force upon device 420. Optional rollers 414 are illustrated making it easier to move device 610 along barrel 20.

Figure 11:
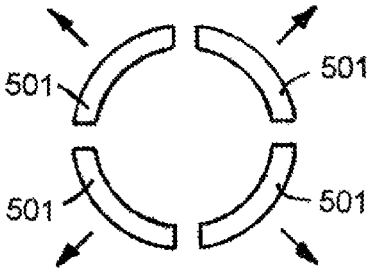
FIG. 11 illustrates in section an exemplary bore cleaning device including four expanding panels, in accordance with the present disclosure.

FIG. 11 illustrates in section an exemplary bore cleaning device including four expanding panels. The illustrated bore cleaning device includes four expanding panels 501 configured to apply outward radial force against the bore of a firearm.

Figure 12:
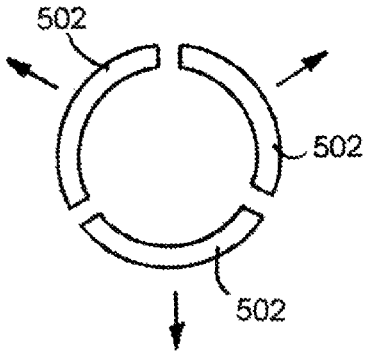
FIG. 12 illustrates in section an exemplary bore cleaning device including three expanding panels, in accordance with the present disclosure.

FIG. 12 illustrates in section an exemplary bore cleaning device including three expanding panels. The illustrated bore cleaning device includes three expanding panels 502 configured to apply outward radial force against the bore of a firearm.

Figure 13:
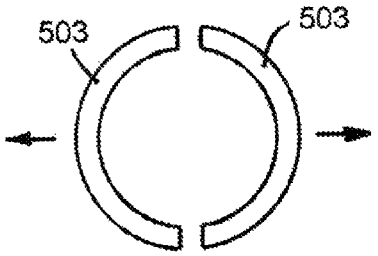
FIG. 13 illustrates in section an exemplary bore cleaning device including two expanding panels, in accordance with the present disclosure.

FIG. 13 illustrates in section an exemplary bore cleaning device including two expanding panels. The illustrated bore cleaning device includes two expanding panels 503 configured to apply outward radial force against the bore of a firearm.

Figure 14:
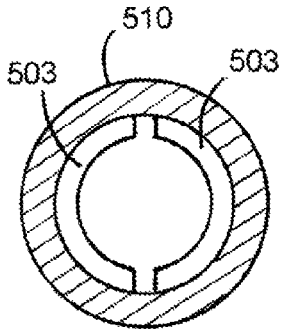
FIG. 14 illustrates in section the two expanding panels of FIG. 13, with an exemplary cleaning material installed around the expanding panels, in accordance with the present disclosure.

FIG. 14 illustrates in section the two expanding panels of FIG. 13, with an exemplary cleaning material installed around the expanding panels. Panels 503 are illustrated surrounded by cleaning materials 510, which can be a fibrous pad, elastic sheathe including wipers, or similar materials. Outward radial forces applied by panels 503 provide force to press the cleaning materials 510 against the bore of a firearm.

Figure 15:
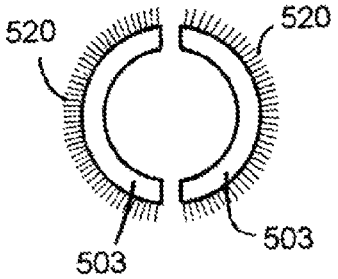
FIG. 15 illustrates in section the two expanding panels of FIG. 13, with exemplary brush bristles installed around the expanding panels, in accordance with the present disclosure.

FIG. 15 illustrates in section the two expanding panels of FIG. 13, with exemplary brush bristles installed around the expanding panels. Panels 503 are illustrated including bristles 520 projecting outwardly from panels 503. Outward radial forces applied by panels 503 provide force to press the bristles 520 against the bore of a firearm.

Figure 16:
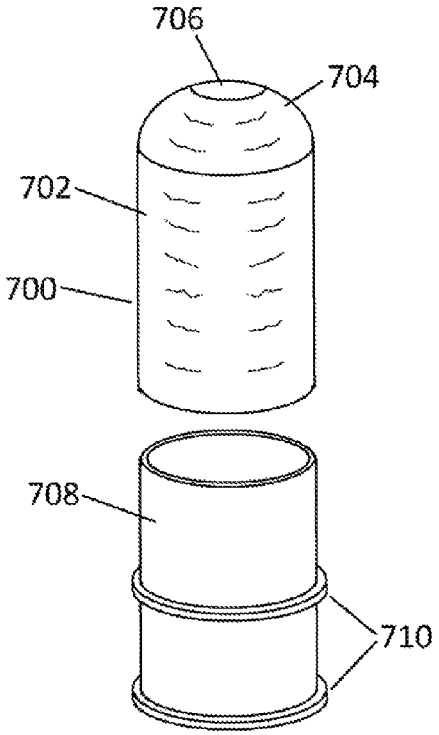
FIG. 16 illustrates an exemplary embodiment of cleaning materials that can be installed to the exemplary bore cleaning device of FIG. 3A, in accordance with the present disclosure.

FIG. 16 illustrates an exemplary embodiment of cleaning materials that can be installed to the exemplary bore cleaning device of FIG. 3A. An upper sleeve 700 is constructed of wadding or similar scrubbing/absorbent materials and includes cylindrical section 702, form fitting round section 704 configured to fit to a rounded top of a forward end cap, and a hole 706 configured to permit a plunger tab to be pulled through the hole. A lower sleeve 708 can be constructed of a rubberized material and can include wiper rings 710 formed there upon. Both sleeve 700 and sleeve 708 are fit upon the bore cleaning device, with sleeve 700 scrubbing the bore and sleeve 708 wiping away all residue from the bore, and both are configured to stretch outward radially slightly when the bore cleaning device contained within the sleeves applies an outward radial force upon the cleaning materials.

Figure 17:
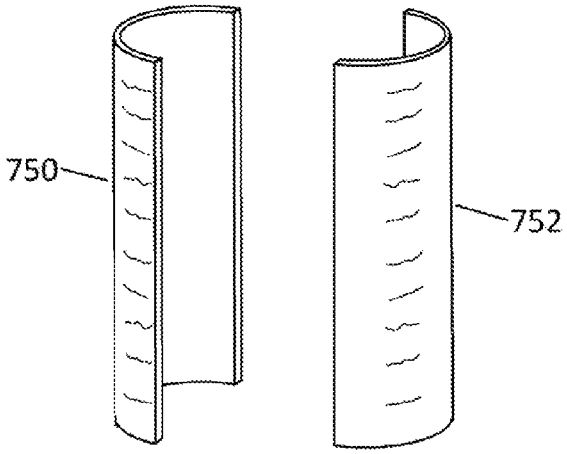
FIG. 17 illustrates an alternative exemplary embodiment of cleaning materials that can be installed to the exemplary bore cleaning device of FIG. 3A, in accordance with the present disclosure.

FIG. 17 illustrates an alternative exemplary embodiment of cleaning materials that can be installed to the exemplary bore cleaning device of FIG. 3A. Scrubbing pads 750 and 752 are illustrated. Each is configured to be adhered or otherwise affixed to the expanding panels of the bore cleaning device. As the panels are pushed outwardly into the extended state, pads 750 and 752 are pressed against the inside of the bore. Pads 750 and 752 can be made of wadding or any other cleaning material.

Figure 18:
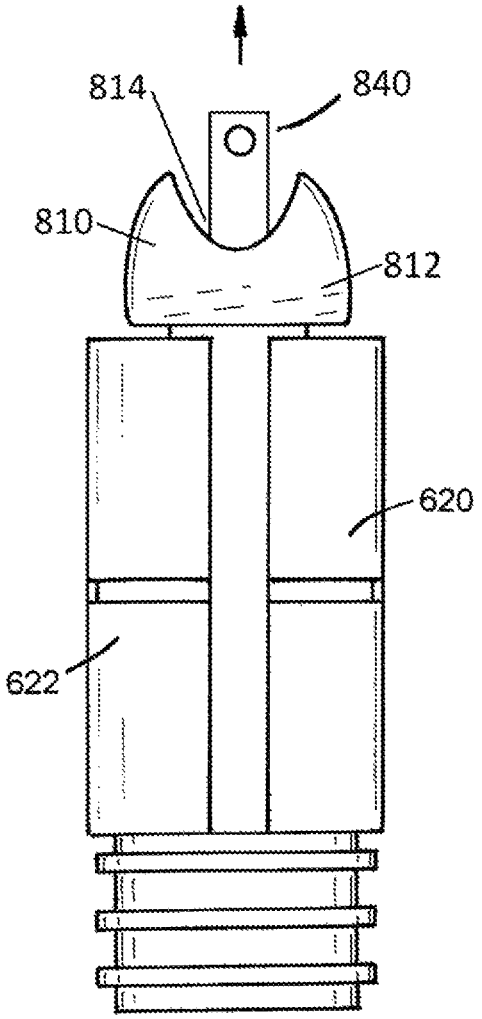
FIG. 18 illustrates an exemplary embodiment of a bore cleaning device similar to the bore cleaning device of FIG. 3B, except that the plunger tab is cylindrical, a hole in a forward end cap is round, and the forward end cap is configured to screw onto the rest of the device, in accordance with the present disclosure.

FIG. 18 illustrates an exemplary embodiment of a bore cleaning device similar to the bore cleaning device of FIG. 3B, except that the plunger tab is cylindrical, a hole in a forward end cap is round, and the forward end cap is configured to screw onto the rest of the device. By making tab 840 of the plunger cylindrical, cap 810 including the round hole 814 through which tab 840 extends can freely spin about the plunger without requiring that the plunger also spin. In this way, cap 810 can included threaded details 812 to permit easy installation of cap 810 to the rest of the device.

Bore cleaning devices as disclosed herein can be made of a number of different materials, including polymers such as polypropylene and acrylonitrile butadiene styrene (ABS). In other embodiments, portions of the bore cleaning devices can be made out of metal such as aluminum. Any metal used in the device should be softer than the steel of a barrel of a firearm to avoid wearing upon the barrel.

The disclosure has described certain embodiments and modifications of those embodiments. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. An apparatus comprising a cylindrically-shaped bore cleaning device configured to clean a bore of a firearm, the device comprising:

a cord configured to pull upon the cylindrically-shaped bore cleaning device in a first direction;

a spring loaded plunger connected to the cord and biased in a second direction opposite the first direction, the spring loaded plunger comprising a plurality of triangle-shaped ramp structures;

at least two expanding panels positioned proximate to the spring loaded plunger, each of said expanding panels including at least one triangle-shaped ramp structure mating to and inverted in relation to one of the triangle-shaped ramp structures of the spring loaded plunger;

wherein a pulling force applied to the cord in the first direction causes the spring loaded plunger to move in the first direction with relation to the expanding panels, thereby causing the triangle-shaped ramp structures of the spring loaded plunger and the expanding panels to move in relation to each other and provide an outward radial force pushing the expanding panels outwardly thereby forcing intimate contact between surfaces of the device and interior walls of the bore.

2. The apparatus of claim 1, further comprising cleaning materials attached to the expanding panels.

3. The apparatus of claim 1, further comprising cleaning materials surrounding the expanding panels.

* * * * *